United States Patent [19]

Troncoso, Jr.

[11] Patent Number: 4,458,659

[45] Date of Patent: Jul. 10, 1984

[54] ARCHERY BOWSTRING RELEASE AID

[76] Inventor: Fernando Troncoso, Jr., 1851 S. Orange Ave., Monterey Park, Calif. 91754

[21] Appl. No.: 423,829

[22] Filed: Sep. 27, 1982

[51] Int. Cl.[3] ..... F41B 5/00

[52] U.S. Cl. ..... 124/35 A

[58] Field of Search ..... 124/35 A, 23 A, 24 R, 124/41 A

[56] References Cited

U.S. PATENT DOCUMENTS

| | | | |
|---|---|---|---|
| 2,929,372 | 3/1960 | Vance | 124/35 A |
| 3,004,532 | 10/1961 | Vance | 124/35 A X |
| 3,608,090 | 9/1971 | Wilson et al. | 124/35 A X |

*Primary Examiner*—Richard J. Apley
*Assistant Examiner*—William R. Browne
*Attorney, Agent, or Firm*—Donald E. Nist

[57] ABSTRACT

An improved archery bowstring release aid is provided which has a preferably flexible, self-supporting resilient ledge generally perpendicular to the length of the release aid and having an opening for an arrow shaft, the opening being bordered by a pair of bowstring-engaging portions. A rear wrist-engaging support member, which can be in the form of a strap, rope or glove and a self-supporting intermediate portion interconnecting the ledge and rear support complete the release aid. The release aid is adapted to be positioned on the medial side of the archer's draw hand, with the bowstring-engaging portions of the ledge facing the archer's palm and temporarily supported by the curved archer's fingers. It may also include a transverse brace member across the intermediate portion. Upon reaching full draw, the archer relaxes his or her fingers and the release aid, particularly the ledge, and usually the intermediate portion, flexes to release the drawn bowstring to fire the arrow forward from the bowstring. The ledge and intermediate portion can be fabricated of wire, flexible plastic or the like, and can be unitary, if desired. The ledge can be designed to be backed by the index and middle finger or by three fingers. The release aid is simple, inexpensive, durable and provides improved accuracy without archer's paradox.

4 Claims, 7 Drawing Figures

ARCHERY BOWSTRING RELEASE AID

BACKGROUND OF THE INVENTION

1. Field of the Invention

The present invention relates to archery equipment and more particularly to an improved archery release aid.

2. Prior Art

Archery bowstring release aids usually comprise simple hooks which must be held in the hand and turned or rotated to release the drawn bowstring. Loops or rope releases are also popular, but they also require some finger movement and the rope drags on the bowstring, slowing it. Caliper-type or other trigger releases are also used. They are usually push button or tang controlled and are very expensive and complicated.

Trigger releases and hooks usually permit the released bowstring to move straight ahead, rather than in an S-curve to produce so-called archer's paradox, as in the case of finger tabs and gloves and some rope releases, and thus are theoretically more accurate than tabs, ropes and gloves. However, most trigger releases are difficult and slow to install on the bowstring, so that they are not suitable for all hunting purposes. Moreover, it is easy to inadvertently vary their holding angle so as to unintentionally torque the bowstring and produce variable accuracy. Hooks are very easy to misfire, and difficult to hold so that the same turning motion (angle and extent) is used from shot to shot; therefore shooting accuracy is difficult to reproduce from shot to shot.

Accordingly, there exists a need for an improved type of archery bowstring release aid which will avoid archer's paradox, be simple, inexpensive and durable and can be easily and quickly fixed to the bowstring. The release aid should be able to draw the bowstring without inadvertent firing, be adaptable to both hunting and target archery and, most important, improve the archer's accuracy in a reproducible manner.

SUMMARY OF THE INVENTION

The improved archery bowstring release aid of the present invention satisfies all the foregoing needs. The release aid is substantially as set forth in the Abstract above. Thus, it comprises a flexible self-supporting ledge set at an angle about perpendicular to an intermediate portion connected thereto and running rearward thereof to a rear support in the form of a wrist strap, glove or rope. A removable transverse brace member may span the intermediate portion and archer's hand adjacent the rear of the fingers.

The ledge and intermediate portion may be integral and of wire, plastic plate, etc. The ledge defines an opening to receive the rear end of an arrow shaft. The free ends of the bowstring-engaging portions of the ledge bordering the opening are adapted to be backed by the archer's curved or bent fingers until release of the bowstring. Thus, the ledge faces the archer's palm. Release is effected merely by straightening the fingers. No finger burn or pinch occurs.

The release aid causes the bowstring to fire straight ahead and thus is extremely accurate, from shot to shot, allows recoil in a direct line rearwardly and with partial absorption by the archer's arm, and nests in the archer's hand, extending along the medial side of the fingers and palm to the wrist. The release aid is flexible and self-supporting and may include a rear support in the form of a glove, wrist strap or rope, which may be adjustable. The length of the intermediate portion may also be adjustable. Further features are set forth in the following detailed description and accompanying drawings.

DRAWINGS

DETAILED DESCRIPTION

FIGS. 1-3

Figure 1:
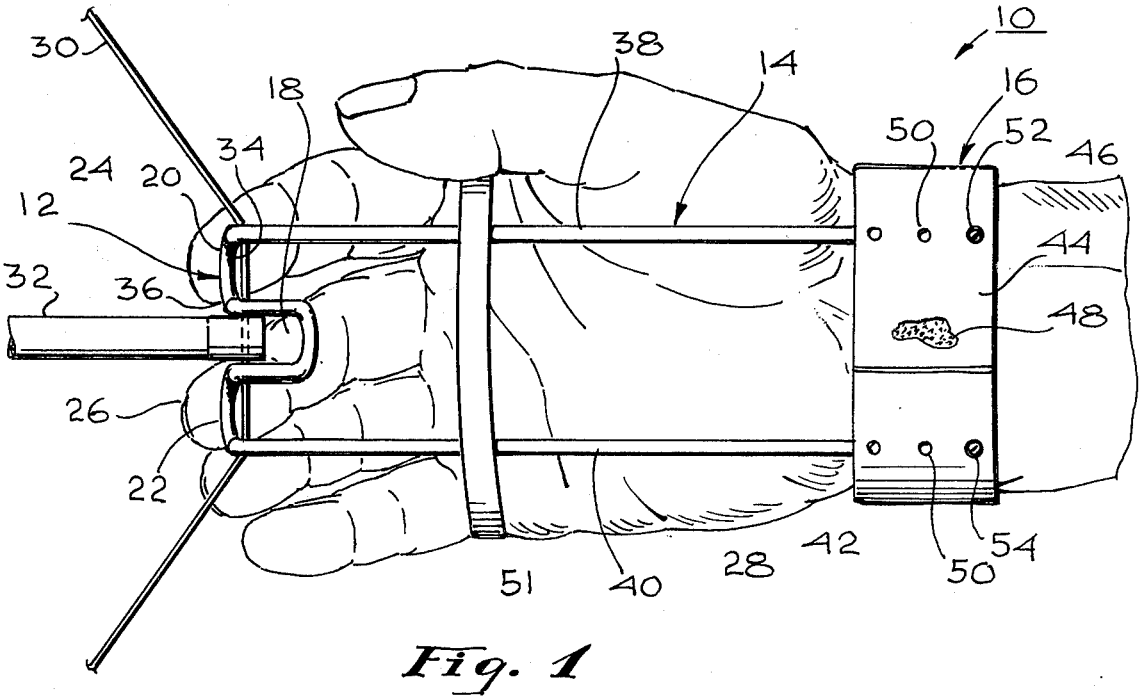
FIG. 1 is a schematic side elevation of a first preferred embodiment of the improved release aid of the present invention, shown in place on an archer's hand and wrist, with an arrow and drawn bowstring.
Figure 2:
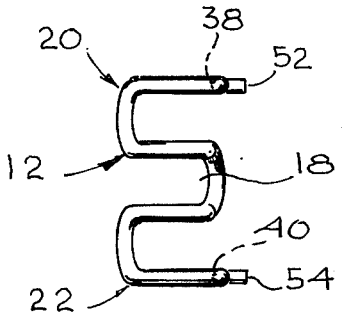
FIG. 2 is a schematic fragmentary front elevation of the release aid of FIG. 1.
Figure 3:
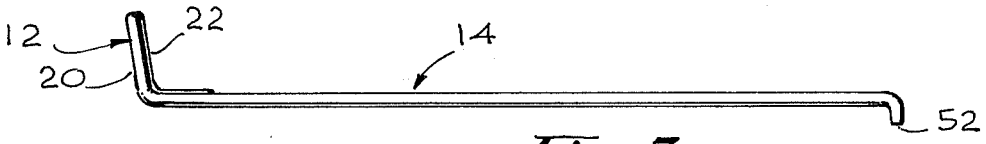
FIG. 3 is a schematic fragmentary top plan view of the release aid of FIG. 1.

Now referring more particularly to FIGS. 1-3 of the accompanying drawings, a first preferred embodiment of the improved release aid of the present invention is schematically depicted therein. Thus, release aid 10 is shown which comprises a front portion in the form of a transverse ledge 12 about perpendicular to a rearwardly directed intermediate portion 14 (FIG. 3) which is connected thereto and to a rear support 16. Ledge 12 and portion 14 are preferably formed of a single piece of copper or other metal wire, and are flexible, resilient and self-supporting. They could also be of plastic or the like.

Ledge 12 is curved to provide an about central opening 18 bordered by two curved bowstring-retaining portions 20 and 22, adapted to face and be supported by the archer's forefinger 24 and middle finger 26, respectively, of the draw hand 28, as shown in FIG. 1, during drawing of bowstring 30 with arrow 32. During that drawing, bowstring 30 is held by the rear surfaces 34 of portions 20 and 22 and the archer's fingers are bent to contact the front surfaces 36 of portions 20 and 22. The rear end of arrow 32 is in opening 18.

Intermediate portion 14 comprises a pair 38 and 40 of parallel wires which are integral with ledge 12, preferably are flexible, are self-supporting and run rearward thereof on the medial side of palm 42 to rear support 16, to which they are releasably connected. Rear support 16 comprises a wrist strap releasably secured to the archer's wrist 46. Strap 44 is of leather, plastic, cloth, etc. and is releasably held in place by, e.g. Velcro 48. Strap 44 includes a series of parallel openings 50 through which the hooked ends 52 and 54 of wires 38 and 40 are releasably engaged to strap 44. Selection of appropriate holes 50 determines the position of ledge 12 in relation to hand 28. A removable transverse brace member 51 in the form of an elastic band may circle poriton 14 and hand 28 at about the rear of the fingers, in order to limit pivoting of portion 14.

As bowstring 30 is being drawn by release aid 10, hand 28 is in a relaxed position in a straight line with the archer's connected wrist and forearm. Fingers 24 and 26 are bent to support portions 20 and 22 and prevent premature release of bowstring 30. Upon reaching full draw and when arrow 32 is fully aimed, fingers 24 and 26 are allowed to straighten so that release aid 10 flexes, particularly ledge 12, and bowstring 30 slips from ledge 12 without the archer flinching. Firing is automatic and is not telegraphed to the archer. The firing sequence is very smooth with no bowstring torque or archer's paradox. The result is a high degree of shooting accuracy. Recoil of the archer's draw arm is straight rearward, so that jarring of the archer is avoided to remove flinching and anticipation and to further promote accuracy. Thus, release aid 10 has an action similar to a caliper release but with improved control and accuracy.

Figure 4:
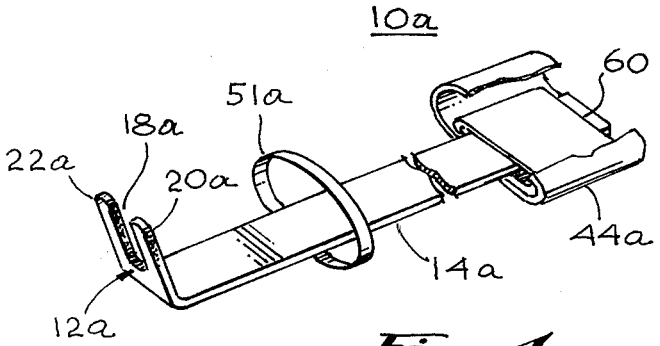
FIG. 4 is a schematic perspective view, partly broken away, of a second preferred embodiment of the improved release aid of the present invention.
Figure 5:
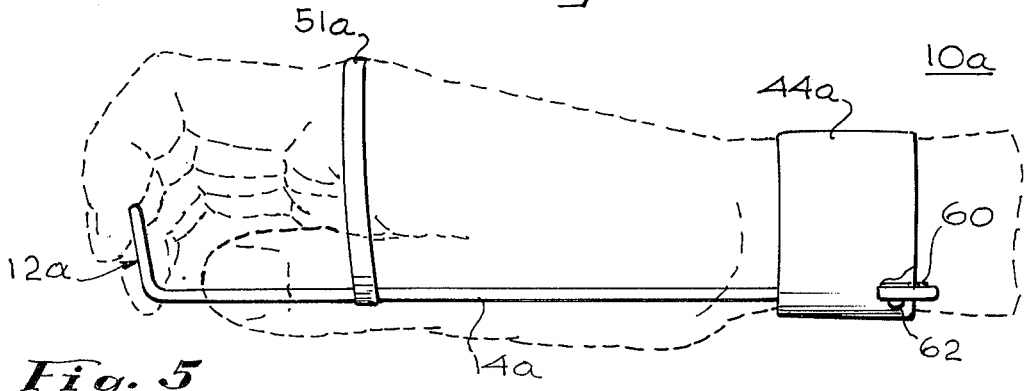
FIG. 5 is a schematic top plan view, partly broken away, of the release aid of FIG. 4.

FIGS. 4 and 5

A second preferred embodiment of the improved release aid of the present invention is schematically depicted therein. Release aid **10*a* is shown. Components thereof which are similar to those of release aid 10 bear the same numerals but are succeeded by the letter "a". Thus, release aid 10*a* comprises a ledge 12*a* and intermediate portion 14*a* formed of a single flexible self-supporting plate of plastic, thin metal or the like. Ledge 12*a* is at an angle to portion 14*a* of slightly less than 90° (FIG. 5). Ledge 12*a* comprises a pair of bowstring-retaining fingers 20*a* and 22*a* spaced apart by an arrow-receiving opening 18*a*. Portion 14*a* terminates at its rear end in a flexible tab 60 secured to an adjustable wrist strap 44*a* by a button 62 in a strap recess (not shown). Elastic brace 51*a* is provided. Release aid 10*a* has substantially the advantages of release aid 10**.

FIG. 6

Figure 6:
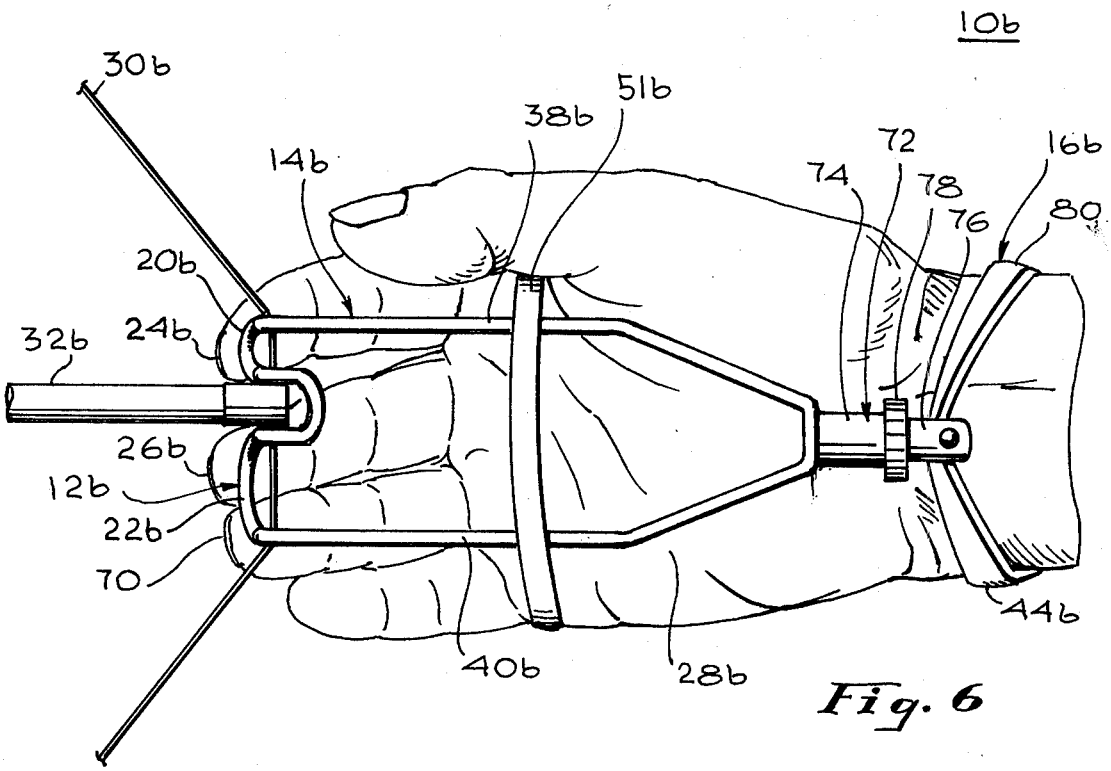
FIG. 6 is a schematic side elevation of a third preferred embodiment of the improved release aid of the present invention, shown on an archer's hand and wrist with a drawn bowstring and arrow; and, FIG. 7 is a schematic side elevation of a fourth preferred embodiment of the improved release aid of the present invention, shown on an archer's hand and wrist with a drawn bowstring and arrow.

A third preferred embodiment of the improved release aid of the present invention is schematically depicted in FIG. 6. Thus, release aid **10*b* is shown. Components thereof similar to those of release aids 10 and 10*a* bear the same numerals but are succeeded by the letter "b". Release aid 10*b* comprises a ledge 12*b*, intermediate member 14*a* and rear support 16*b*. Ledge 12*b* has the configuration of ledge 12 except that portion 22*b* is wider than portion 22 and is backed by fingers 26*b* and 70 (third finger) of hand 28*b*. Portion 14*b* is the same as portion 14, being formed of wires 38*b* and 40*b* integral with ledge 12*b*, but running to a rear adapter 72 comprising a cylindrical fitting 74 within which a rod 76 is adjustably slidably received and releasably locked in place by screw 78 to adjust the length of aid 10*b*. Rod 76 bears at its rear end a strap 44*b* in the form of a loop 80. Elastic brace 51*b* encircles portion 14*b* and hand 28*b*. Bowstring 30*b* can be drawn by release aid 10*b* and released to propel arrow 32*b* forward, substantially as described for release aid 10**.

FIG. 7

Figure 7:
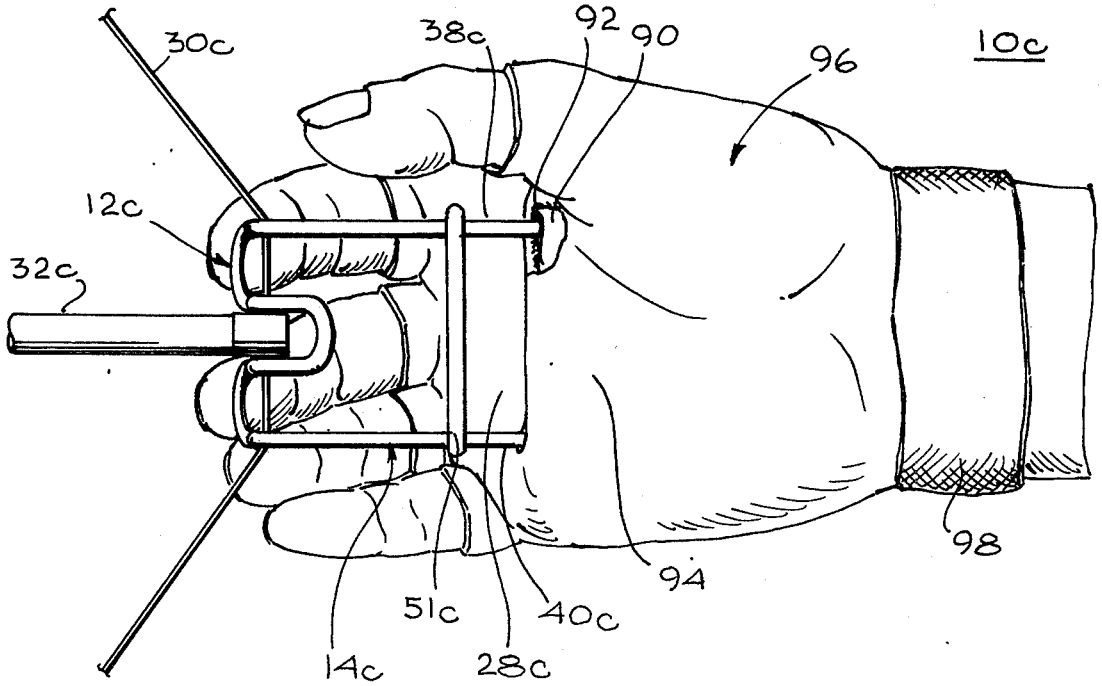

A fourth preferred embodiment of the improved release aid of the present invention is schematically depicted in FIG. 7. Release aid **10*c* is shown. Components thereof similar to those of release aids 10, 10*a* and 1O*b* bear the same numerals but are succeeded by the letter "c". Release aid 10*c* comprises ledge 12*c* and wires 38*c* and 40*c* substantially identical to ledge 12 and wires 38 and 40. Wires 38*c* and 40*c* are secured at their rear ends to a cross bar 90 secured, as by sewing 92, into the palm 94 of substantially fingerless glove 96. An elastic brace 51*c* is secured over portion 14*c* and anchored in glove 96 (FIG. 7). Brace 51*c* is optional, as are braces 51, 51*a* and 51*b*. Glove 96 is of leather, cloth, etc. and has a rear elastic wrist band 98 to help keep glove 96 is placed on hand 28*c* while drawing bowstring 30*c* with arrow 32*c*. Release aid 10*c* generally functions similar to release aid 10**.

The release aid of the present invention can be very rapidly slapped over a bowstring in order to trap it between the aid and the fingers so as to be able to rapidly draw it, as during hunting situations where rapid shooting is essential to success. The release aid functions smoothly and reproducibly for optional results without adjustment. Various other advantages are as set forth in the foregoing.

Various changes, modifications, alterations and additions can be made in the improved release aid of the present invention, its components and their parameters. All such changes, modifications, alterations and additions as are within the scope of the appended claims form part of the present invention.

What is claimed is:

1. An improved archery bowstring release aid, said release aid comprising, in combination:

a. a front self-supporting bowstring-retaining ledge disposed generally transverse of said release aid, said ledge defining an opening adapted to receive the rear end of an arrow shaft and a pair of bowstring-engaging portions on opposite sides of said opening;

b. A rear support adapted to releasably engage an archer's wrist to hold said release aid in place; and, c. An elongated substantially self-supporting intermediate portion interconnecting said front ledge and rear support and adapted to extend along the length of an archer's palm, said release aid being flexible and self-supporting to permit said ledge to pivot and flex to effect release of a drawn bowstring when said ledge is not supported by an archer's fingers, said ledge being generally perpendicular to said intermediate portion, said ledge and intermediate portion comprising a unitary length of flexible resilient wire, wherein said bowstring-engaging portions extend toward an archer's palm when said aid is in operative position, and wherein a transverse brace overlies said intermediate portion and is positioned to receive an archer's palm.

2. The improved release aid of claim 1 wherein said bowstring-engaging portions of said ledge are adapted to be supported, respectively, by the forefinger and middle finger of the archer's release hand, and said brace is elastic and positioned to encircle an archer's palm about the front end thereof.

3. The improved release aid of claim 1 wherein said rear support comprises a wrist strap.

4. The improved release aid of claim 3 wherein said strap includes means for adjusting its width and the effective length of said intermediate portion.

* * * * *